US005165171A

United States Patent [19]

MacLean

[11] Patent Number: 5,165,171

[45] Date of Patent: Nov. 24, 1992

[54] FOOD SERVING DEVICE

[76] Inventor: Mark A. MacLean, 711 - 75 Eastdale Ave., Toronto, Ontario, M4C 5N3, Canada

[21] Appl. No.: 777,125

[22] Filed: Oct. 16, 1991

[51] Int. Cl.[5] ..... B25F 1/04; B25F 1/00; B26B 3/00

[52] U.S. Cl. ..... 30/114; 30/136; 30/302

[58] Field of Search ..... 30/136, 114, 302, 316; 99/450, 450.5

[56] References Cited

U.S. PATENT DOCUMENTS

| | | | |
|---|---|---|---|
| 1,931,388 | 10/1933 | Ling | 30/114 |
| 2,067,247 | 1/1937 | Soteros | 30/114 |
| 2,232,204 | 2/1941 | Besocke et al. | 30/114 |
| 2,800,714 | 7/1957 | Evans | 30/114 |
| 4,136,447 | 1/1979 | Gillham, Sr. | 30/302 |
| 4,890,549 | 1/1990 | Steiner et al. | 30/136 |

FOREIGN PATENT DOCUMENTS

| | | | |
|---|---|---|---|
| 627947 | 8/1949 | United Kingdom | 30/114 |

*Primary Examiner*—Douglas D. Watts
*Assistant Examiner*—Paul M. Heyrana, Sr.
*Attorney, Agent, or Firm*—Smart & Biggar

[57] ABSTRACT

A unitary metal pizza slice server has a triangular food support surface with a first handle portion projecting from its base and an overlying second handle portion resiliently joined at the distal end of the first portion to form a U-shape handle. The second handle portion terminates in a concave U-shaped food gripper facing the base of the triangular food support surface. The handle has a zone proximate the food support surface of a sufficient width and length in order to dissipate heat from a piping hot pizza slice on the food support surface so that the portion of the handle beyond this zone may be gripped by an unsheathed hand of a user. The handle is also sufficiently long to ensure sanitary serving of the pizza slice.

3 Claims, 2 Drawing Sheets

FOOD SERVING DEVICE

BACKGROUND OF THE INVENTION

1. Field of the Invention

This invention relates to a device for serving a hot food product.

2. Description of the Related Art

In serving, for example, hot pizza pie at a commercial establishment, the server may employ a knife to cut a slice from the pizza pie and then a spatula to remove this slice from the pie. There is the risk of the pizza slice falling from the spatula and to ensure against this the server might employ a second implement or may touch the pizza slice. There is also the risk of contamination due to the server being too close to the slice.

U.S. Pat. No. 4,890,549 to Steiner et al. issued Jan. 2, 1990 discloses an implement which may be used in the serving of pizza pie slices. The implement has a food support surface and a food gripper resiliently joined to one end of the food support surface. The implement may be employed by a user placing his fingers under the food support surface and using his thumb to position the food gripper over the food support surface. The food support surface may then be slid under a pizza slice and the implement used in a pincer-like fashion to grip the pizza slice. The implement further includes a serrated edge along the food support surface to facilitate cutting a pizza slice from a pizza pie. This implement suffers a drawback that the user's hand is in close proximity to the pizza slice presenting the possibility of direct contact with the slice or contaminating the slice due to contaminants falling from the user. Furthermore, due to the proximity of the user's hand to the slice, this implement has no utility in a commercial setting where piping hot slices are dispensed from a metal tray just after the tray has been removed from a pizza oven. Yet further, the implement of Steiner could not be modified for use in a commercial setting by the addition of insulation since insulated materials are generally impermissible in commercial food serving implements. Indeed, commercially used implements must generally be constructed from stainless steel.

Accordingly, this invention seeks to overcome drawbacks of known hot food serving devices.

SUMMARY OF THE INVENTION

According to the present invention, there is provided a unitary food serving device for serving individual slices of a hot food product, comprising: a food support surface; a handle comprising a first handle portion integrally formed at one end with said food support surface and projecting away from said food support surface to a distal end, and a second handle portion overlying said first handle portion and resiliently joined to said first handle portion at said distal end so as to form a U-shaped handle, said second handle portion extending so that its free end overlies said food support surface, said second handle portion terminating in a food gripper having a concave U-shape facing said food support surface whereby said food gripper is adapted to grip the crust of a pizza pie, said handle having an unhandled handle zone proximate said food support surface, said unhandled handle zone being sufficiently long and wide to sufficiently dissipate heat transmitted by food on said food support surface so as to leave the remainder of said handle beyond said unhandled handle zone comprising a zone available for gripping by an unsheathed hand of a user, whereby said handle may be taken up by an unsheathed hand of a user at said zone of said handle beyond said unhandled handle zone and squeezed to grip hot food on said food support surface to facilitate serving the food.

BRIEF DESCRIPTION OF THE DRAWINGS

In the figures which disclose example embodiments of the invention,

FIG. 2 is a top view of the food serving device of FIG. 1, and.

DESCRIPTION OF THE PREFERRED EMBODIMENTS

Figure 1:
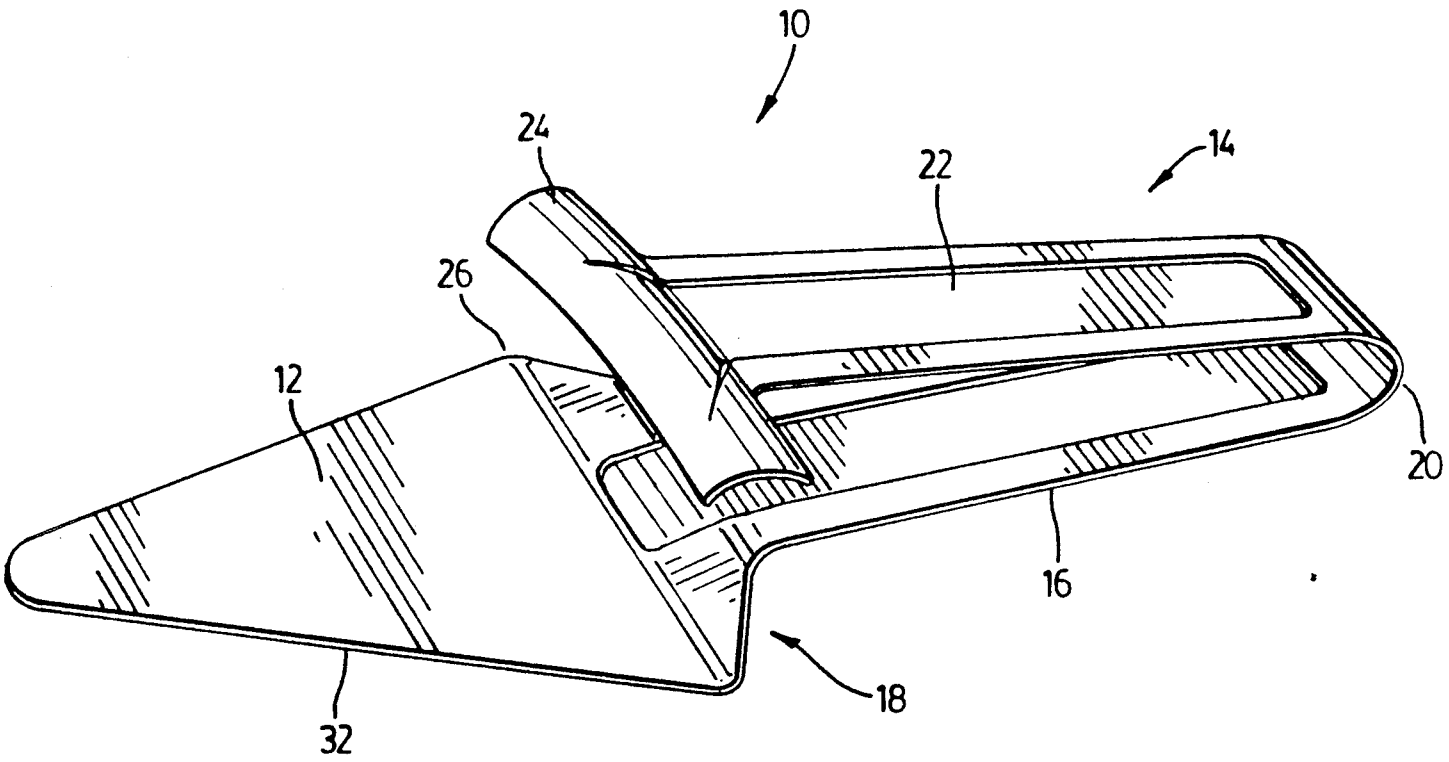
FIG. 1 is perspective view of a food serving device made in accordance with this invention.
Figure 2:
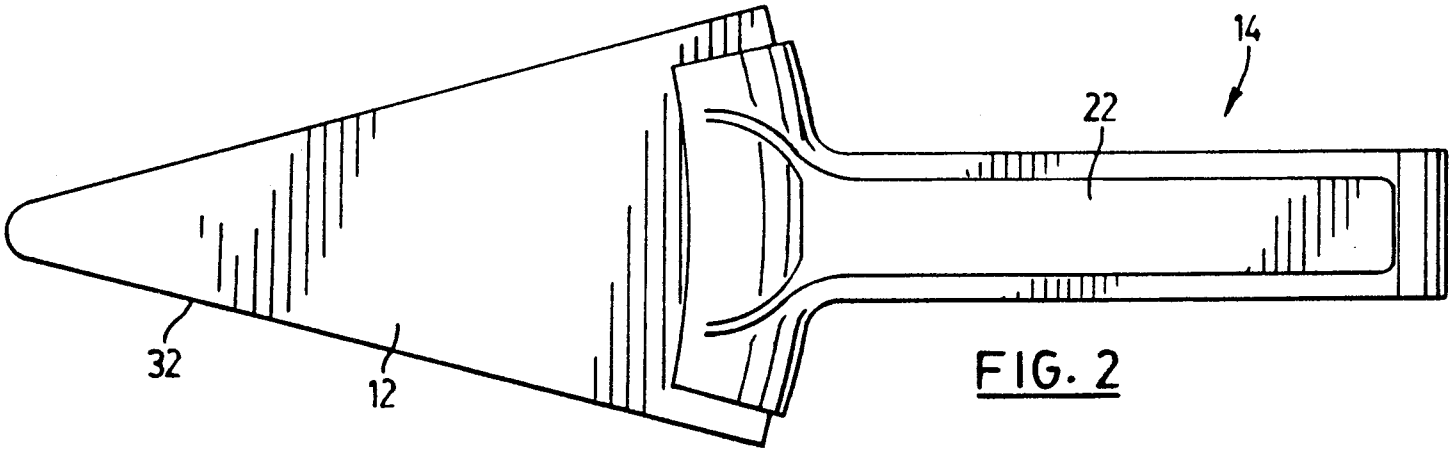

With reference to the figures, a food serving device 10 for serving slices of a hot food product comprises a food support surface 12 and a handle 14. The handle 14 comprises a first handle portion 16 integrally formed at one end 18 with food support surface 12 and projecting away from the food support surface to a distal end 20. A second handle portion 22 overlies the first handle portion 16 and is resiliently joined to the first handle portion at distal end 20 so that the handle 14 is U-shaped. The free end 24 of the second handle portion overlies the base 26 of the food support surface 12. This free end of the second portion comprises a food gripper.

Figure 3:
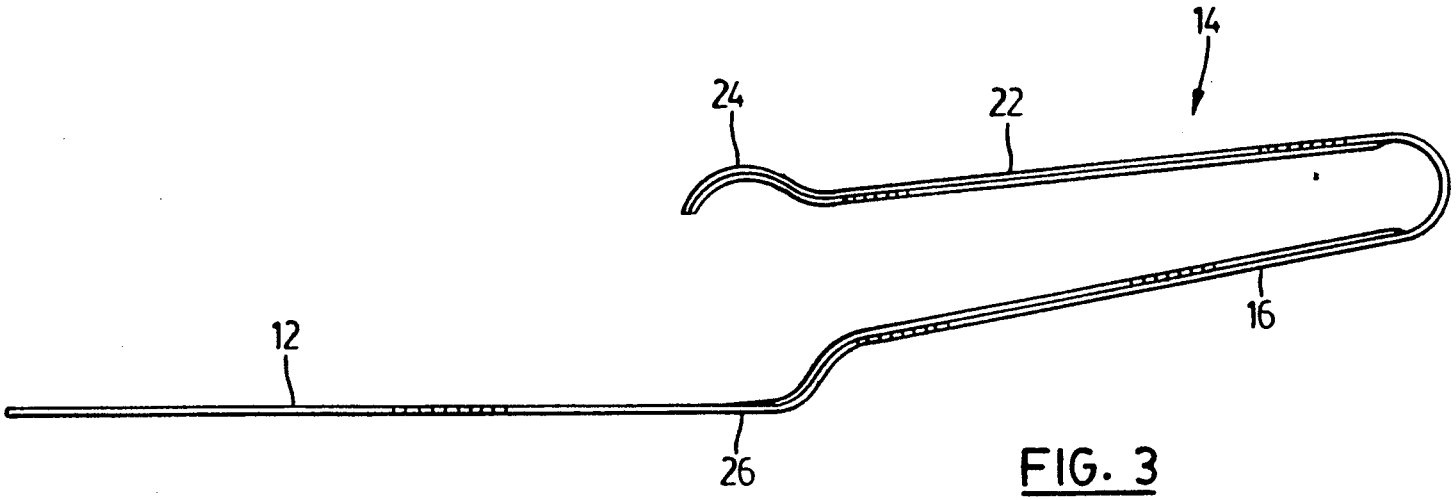
FIG. 3 is a side view of a food serving device of FIG. 1.

As is best seen in FIG. 3, the food gripper forms a concave U-shape facing the base of portion 26 of the food support surface.

The food support surface is triangular with the first handle portion 16 projecting from the base 26 of the food support surface. One edge 32 of the food support surface is a knife edge.

The server is integrally formed.

The server may be made from a heat transmissive material, such as stainless steel, in which case the handle 14, due to its length and width, has a heat dissipation zone 28 and a gripping zone 30. More particularly, the handle provides a handle zone 28 proximate the food support surface 12 which is of such a length and width that it sufficiently dissipates heat transmitted by food on the food support surface so as to leave the remainder (zone 30) of the handle beyond the zone 28 available for gripping by an unsheathed hand of a user. Thus, zone 28 is, in use, an unhandled portion of the handle while the remainder 30 of the handle 14 is intended for gripping by a user. Furthermore, zone 28 of handle 14 ensures the user remains remote from the pizza slice thereby ensuring the sanitary serving of the slices. The handle 14 may be 115 mm in length with zone 28 comprising up to about one-half of this length. The handle may be about 30 mm wide.

Commercial food implements must generally be made of stainless steel. The subject food serving device, when made of stainless steel, has particular utility in serving extremely hot slices of pizza from a pizza pie. Thus, it is adapted for use in a commercial setting in order to serve slices of pizza from a metal plate even immediately after the pizza pie has been removed from a pizza oven due to the heat dissipation properties of the handle.

Where the server is made from a non-heat transmissive material, such as plastic, unhandled zone 28 of the handle 14 still ensures sanitary serving of slices and so the device is well adapted for use in a residential setting in serving pizza obtained from a commercial establishment.

There may be a visual indication on handle 14 indicating zone 28 and zone 30 of the handle.

In operation, a user grips zone 30 of handle 14 and utilizes knife edge 32 of the food support surface 12 in order to cut a slice of pizza pie. Thereafter, the food support surface may be slid under the slice of pizza pie and the handle squeezed so that the food gripper 24 grips the crust portion of the pizza slice. It will be appreciated that the concave U-shape of the food gripper 24 facilitates its gripping of the pizza crust. After gripping, the pizza slice may be dispensed as desired.

In order to adapt the food serving device to the serving of other hot food products, the food support surface may take different shapes. For example, the food support surface could be square such that the device is adapted for the serving of square slices of pizza. Other modifications will be apparent to those skilled in the art and, accordingly, the invention is defined in the claims.

What is claimed is:

1. A unitary metal food serving device for serving individual slices of a hot food product, comprising:

a food support surface;

a handle comprising a first handle portion integrally formed at one end with said food support surface and projecting away from said food support surface to a distal end, and a second handle portion overlying said first handle portion and resiliently joined to said first handle portion at said distal end so as to form a U-shaped handle, said second handle portion extending so that its free end overlies said food support surface, said second handle portion terminating in a food gripper having a concave U-shape facing said food support surface whereby said food gripper is adapted to grip the crust of a pizza pie, said handle having an unhandled handle zone proximate said food support surface, said unhandled handle zone being sufficiently long and wide to sufficiently dissipate heat transmitted by food on said food support surface so as to leave the remainder of said handle beyond said unhandled handle zone comprising a zone available for gripping by an unsheathed hand of a user, whereby said handle may be taken up by an unsheathed hand of a user at said zone of said handle beyond said unhandled handle zone and squeezed to grip hot food on said food support surface to facilitate serving the food.

2. The food serving device of claim 1 wherein said food support surface is generally triangular with said first handle portion projecting from the base of said triangular shaped food support surface and said food gripper of said second handle portion terminating proximate the base of said food support surface.

3. The food serving device of claim 2 wherein one edge of said food support surface is formed as a knife edge whereby food may be cut by said knife edge.

* * * * *